US005864226A

United States Patent [19]

Wang et al.

[11] Patent Number: 5,864,226

[45] Date of Patent: Jan. 26, 1999

[54] LOW VOLTAGE REGULATOR HAVING POWER DOWN SWITCH

[75] Inventors: Nanlei Larry Wang, Palo Alto; Ronald Patrick Green, Santa Clara, both of Calif.

[73] Assignee: EIC Enterprises Corp., Tortola, Virgin Islands (Br.)

[21] Appl. No.: 797,494

[22] Filed: Feb. 7, 1997

[51] Int. Cl.[6] ..... G05F 1/565

[52] U.S. Cl. ..... 323/273; 257/195

[58] Field of Search ..... 323/273, 276, 323/274, 275, 281; 257/195, 192, 194, 197

[56] References Cited

U.S. PATENT DOCUMENTS

| | | | |
|---|---|---|---|
| 4,536,699 | 8/1985 | Baker | 323/276 |
| 4,560,918 | 12/1985 | Callen | 323/273 |
| 5,012,318 | 4/1991 | Honjo | 357/43 |
| 5,293,084 | 3/1994 | Itoh et al. | 257/197 |
| 5,422,501 | 6/1995 | Bayraktaroglu | 257/195 |

*Primary Examiner*—Peter S. Wong
*Assistant Examiner*—Derek J. Jardieu
*Attorney, Agent, or Firm*—Townsend and Townsend and Crew LLP; Henry K. Woodward

[57] ABSTRACT

A low voltage regulator integrated circuit for high speed/high frequency circuits incorporates a field effect transistor switch with a heterojunction bipolar transistor in order to reduce voltage requirements of the circuit and allow lower power voltages to be regulated. A first field effect transistor connects an unregulated power input terminal to a regulated power output terminal with a bias circuit including the heterojunction bipolar transistor provided to maintain conductance of the field effect transistor in regulating a voltage on the output terminal. A second field effect transistor can be included in the circuit to provide a power down or power saving mode of operation. An input voltage range of the voltage regulator is reduced from 3–3.5 V to 2–2.3 V using the integrated field effect transistor/heterojunction bipolar transistor device structure.

3 Claims, 2 Drawing Sheets

LOW VOLTAGE REGULATOR HAVING POWER DOWN SWITCH

BACKGROUND OF THE INVENTION

This invention relates generally to integrated circuit voltage regulators for high speed and high frequency applications, and more particularly, the invention relates to such a regulator for low voltage circuits.

Many circuit applications are now operating in a voltage range from 5 V down to 3 V and below. A typical voltage regulator reduces the output variation to a much smaller range than the input voltage thus minimizing the total bias current variation against bias voltage.

For high speed and high frequency circuits, silicon bipolar transistors and heterojunction bipolar transistors are employed in the voltage regulators. Comparing these two transistor technologies, a Gallium Arsenide HBT has a $V_{be}$ of 1.4 V during operation versus 0.8 V for a silicon bipolar transistor. The high $V_{be}$ of the GaAs HBT increases the difficulty in designing a regulator at low voltages with a power down feature. This can best be illustrated by reference to the conventional voltage regulator illustrated in FIG. 1.

Referring to FIG. 1, an input voltage, Vin is passed through a transistor Q1 to provide a regulated output voltage Vout. Resistors R2, R3 are serially connected between Vout and circuit ground with a common terminal being provided with a reference voltage, Vref, which controls the bias on bipolar transistor Q2. Transistor Q2 is connected between the base of transistor Q1 and circuit ground for providing a bias voltage to transistor Q1. A resistor R1 connects the collector of transistor Q2 to Vin.

In a typical application, the circuit of FIG. 1 has the following relationships:

$$\text{Vref is about } 1.4\text{V}$$
$$\text{Vout} > \text{Vref} = 1.4\text{V}$$
$$\text{V1} = \text{Vout} + V_{beQA1} > 2.8\text{V}$$
$$\text{Vin} = \text{V1} + \Delta\text{V} \sim 3\text{V, with } \Delta\text{V} \sim 0.2\text{V}$$

From the foregoing analysis, it will be appreciated that the circuit has difficulty in functioning when Vin drops below 3 V. Even at 3 V, it is difficult to add a power down or power saving feature to the circuit of FIG. 1. The power down feature is illustrated in the voltage regulator of FIG. 2 which is identical to the voltage regulator of FIG. 1 with the addition of transistor Q3 serially connected between transistor Q1 and Vout with a power saving voltage, PS, applied through resistor R4 to the base of transistor Q3. When PS is below 1.3 V, the power saving transistor Q3 is turned off. As a result, there is no current flowing out of Vout and no current flows through transistors Q1 and Q2. However, when the voltage PS is set to Vout (regulated) plus $V_{be}$ of transistor Q3, transistor Q3 is in a saturation mode with a very low $V_{ce}$, which can be less than 0.5 V. The emitter voltage of transistor Q1 is at a voltage greater than Vout+$V_{ce(Q3)}$, or approximately 1.9 V. Therefore, Vin must be greater than 3.5 V. This increase comes from the collector emitter voltage drop of transistor Q3.

Accordingly, the use of a low input voltage presents a challenge to bipolar technology in providing a voltage regulator. A GaAs HBT faces the challenge for Vout equal 3 to 3.5 V, and the silicon bipolar transistor faces the same challenge at about 2 V.

SUMMARY OF THE INVENTION

In accordance with the present invention, a voltage regulator integrated circuit for high speed and high frequency applications includes a field effect transistor connecting an unregulated power supply voltage to a regulated power voltage output. Bias circuitry is provided for biasing the field effect transistor and maintaining conductance thereof to regulate the output voltage. In accordance with a preferred embodiment of the invention, the bias circuit includes a heterojunction bipolar transistor having a base voltage derived from the regulated output voltage and the conductance of which varies a bias potential on the gate of the field effect transistor to offset fluctuations in the unregulated input voltage. The heterojunction bipolar transistor and the field effect transistor preferably comprise a unitary structure.

A second field effect transistor can be connected in the regulator circuit to function in a power saving or power down mode of operation. Advantageously, input voltage range for the voltage regulator is reduced to 2.0–2.3 V. The integrated FET and heterojunction bipolar transistor allows the regulator to function in a high speed and high frequency application while providing a wide bias voltage range.

The invention and objects and features thereof will be more readily apparent from the following detailed description and appended claims when taken with the drawings.

DETAILED DESCRIPTION OF THE PREFERRED EMBODIMENT

Figure 3:
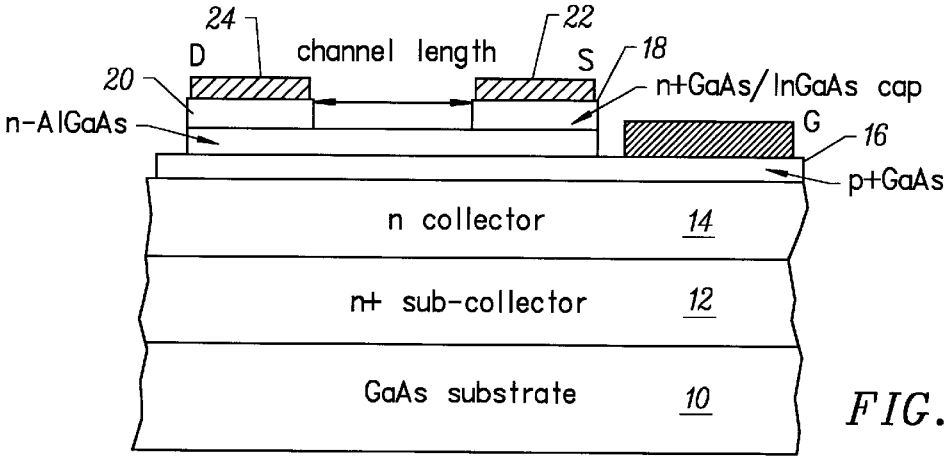
FIG. 3 is a section view of an integrated field effect transistor and heterojunction bipolar transistor structure useful in the present invention.

FIG. 3 is a side view illustrating an N-channel junction field effect transistor as a unitary structure integrated with a heterojunction bipolar transistor which is useful in a regulator circuit in accordance with the present invention. The two transistors comprise an integrated device in which a device region is shared by both transistors, as will be described. The structure includes a substrate 10 of III–V semiconductor material such as Gallium Arsenide (GaAs), an N+ subcollector layer 12 of GaAs formed in substrate 10 and an N-doped GaAs collector 14 formed over the N+ layer 12 and abutting a surface of the substrate 10. Formed on the substrate over the N-doped collector 14 is a P+ layer 16 of GaAs which functions as the base of the bipolar transistor, and formed on the P+ layer 16 is an N− layer of Aluminum Gallium Arsenide (AlGaAs) which functions as the emitter of the heterojunction bipolar transistor and also as the channel region for the field effect transistor. Completing the field effect transistor are spaced N+ layers 18, 20 of Gallium Arsenide/Indium Gallium Arsenide (GaAs/InGaAs) cap layers, each having a metal contact 22, 24 formed thereon and functioning as the source and drain regions of the enhancement mode field effect transistor. The P+ base layer 16 of the bipolar transistor functions as the controlling gate for the channel region of the field effect transistor. There are many other embodiments of an integrated FET, such as adding a gate metal on the n-emitter layer, or through use of the sub-collector layer as the n-channel.

Figure 4:
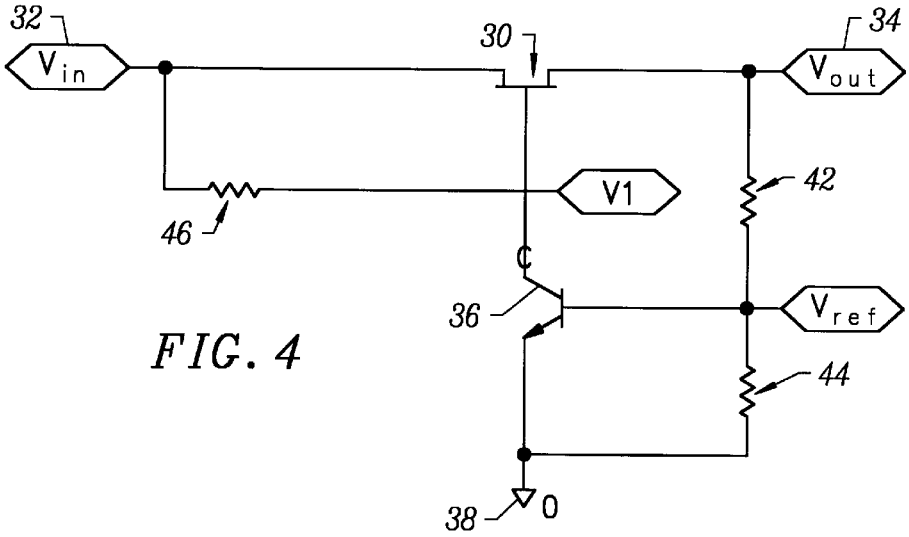
FIG. 4 is a schematic of a voltage regulator integrated circuit using the structure of FIG. 3 in accordance with one embodiment of the invention.

FIG. 4 is a schematic of a voltage regulator integrated circuit incorporating the structure of FIG. 3 in accordance with one embodiment of the invention. The field effect transistor 30 connects the unregulated voltage input terminal 32 and the regulated voltage output terminal 34. The heterojunction bipolar transistor 36 connects the gate or channel region of field effect transistor to circuit ground at 38. Again, serially connected resistors 42, 44 connect the output terminal 34 to circuit ground 38 with the common terminal connected to the base of heterojunction bipolar transistor 36. Resistor 46 connects the input terminal 32 to the common terminal of field effect transistor 30 and heterojunction bipolar transistor 36.

Figure 1:
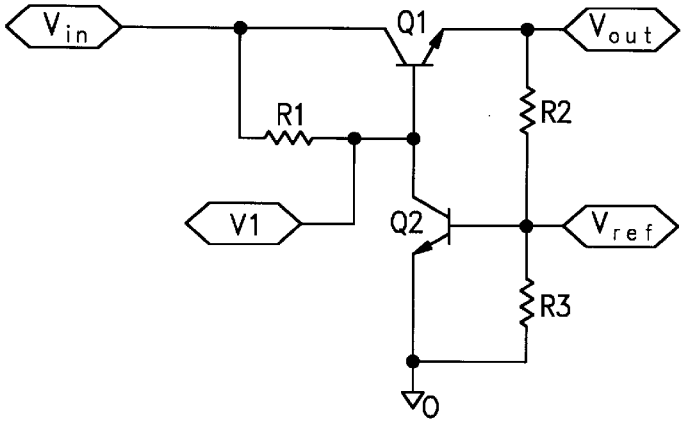
FIG. 1 PRIOR ART
FIG. 1 is a schematic of a prior art voltage regulator integrated circuit.
Figure 2:
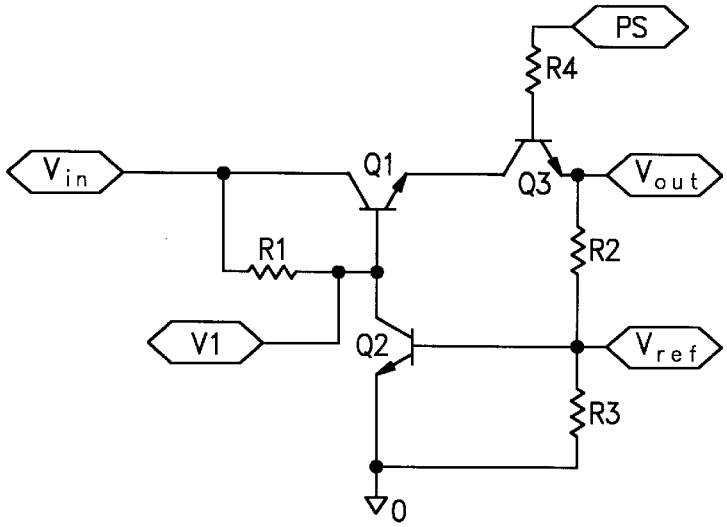
FIG. 2 PRIOR ART
FIG. 2 is a schematic of a prior art voltage regulator integrated circuit including a power down switch.

With the N-channel FET 30 integrated on the same wafer with the heterojunction bipolar transistor 36, and by choosing the field effect transistor design to be enhancement mode as described above, a low input voltage regulator is realized. The serial bipolar transistor of the prior art circuit of FIG. 1 is replaced by the FET, and for a typical FET Vgs up to 0.6 V is allowed before gate-channel turn on voltage. With Vgs approximately 0.3 V:

$$V1=Vout+Vgs>1.4+0.3=1.7V$$

$$Vin=V1+\Delta V\sim 1.9V, \text{ with } \Delta V\sim 0.2V$$

Because the Vgs of an FET is much lower than the Vbe of the heterojunction bipolar transistor (0.3 V versus 1.4 V), a much lower input voltage, Vin, is permissible for the voltage regulator to operate satisfactorily. The Vref is still provided by a heterojunction bipolar transistor since Vbe of the heterojunction bipolar transistor is much more uniform in production than the Vgs of a field effect transistor.

Figure 5:
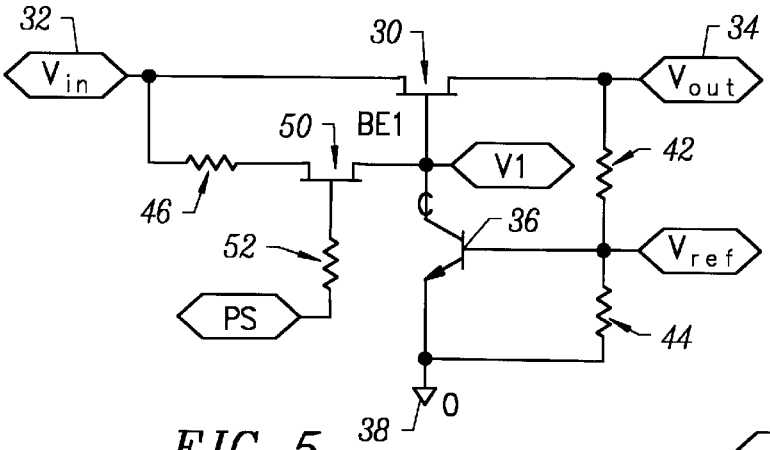
FIG. 5 and FIG. 6 are embodiments of the invention and including switches for a power down mode of operation.
Figure 6:
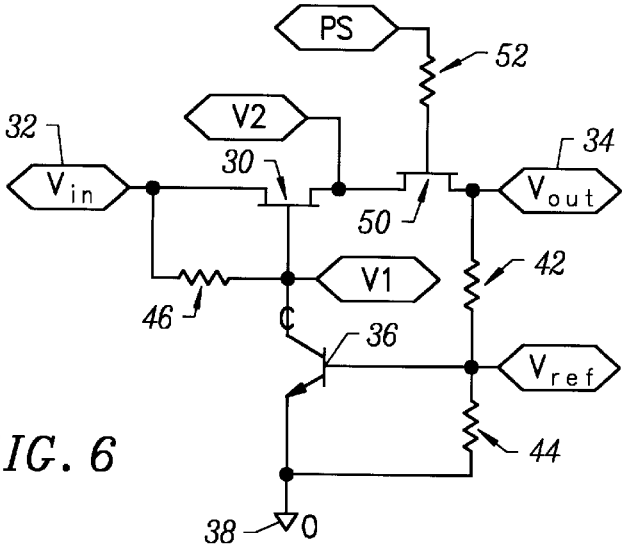

The circuit of FIG. 4 is easily modified to include a power saving or power down feature, as illustrated in the schematics of FIG. 5 and FIG. 6, which are similar to the schematic of FIG. 4 and like elements have the same reference numerals. In FIG. 5, a second field effect transistor 50 is serially connected between resistor 46 and the common terminal of FET 30 and HBT 36. Resistor 52 connects the gate of FET 50 to a power saving (PS) voltage source. Transistor 50 is kept on when the PS pin is connected to a high voltage (greater than 2.0 V). With a large resistance value for resistor 52, even if the PS terminal is connected to a very high voltage, FET 50 can only conduct a small gate current. With the IDSS of FET 50 much larger than the required current flowing through resistor 46, the Vds of FET 50 is small (few tenths volt). Therefore, the Vin range is only raised by a few tenths volt.

When PS is pulled to ground potential, FET 50 has Vgs equal 0, and is turned off (for an enhancement mode FET). Without current flowing, FET 30 is also turned off and Vout is reduced to 0 V. There is no current flowing in the regulator nor in the output circuitry except for leakage current.

FIG. 6 is another embodiment of the regulator circuit of FIG. 4 as modified to include a power saving or power down feature. Again, like elements in FIG. 4 and FIG. 6 have the same reference numerals. In FIG. 6 the second field effect transistor 50 is serially connected between the first field effect transistor 30 and the output terminal 34. When the PS voltage is high, the voltage at the common terminal of FET devices 30, 50 is only a few tenths volt higher than Vout with FET 50 functioning as a simple resistor. Therefore, the Vin range is raised by the voltage drop across the two field effect transistors. Again, a large resistance for resistor 52 on the gate of FET 50 limits the gate current when the PS voltage is high. When the PS voltage is brought to 0 V, FET 50 is turned off and Vout is brought to 0 V. HBT 36 is turned off, and the voltage on the common terminal of FET devices 30, 50 is pulled high.

Accordingly, both circuits of FIGS. 5 and 6 offer voltage regulation function and a power down feature with the extra integrated N-channel FET. In the case of the threshold voltage of the N-channel FET being less than 0 V (depletion mode) due to poor process control, the above circuits are only marginally handicapped. Assuming the FET pinch-off voltage drops from +0 V to −0.5 V in the circuit of FIG. 5, V1 can be charged to +0.5 V (so that Vgs equals −0.5 V for FET 50 and shut off). With Vgs equals 0.5 V on the gate of FET 30, the source/Vout can be charged to 0.5 V higher, or 1 V. Vout equal 1 V is not enough to turn on HBT 36 for a normal regulator operation, nor is it sufficient to turn on the current source for the high speed/high frequency circuit. The only leakage current in the power down mode is the 1.0 V cross resistors 42, 44.

In the circuit of FIG. 6, with PS equal 0 V, FET 50 can have the source/Vout go up at most +0.5 V, which is still insufficient to turn on HBT transistor 36 or the high speed/high frequency circuit. The leakage is the 0.5 V across series resistors 42, 44.

With the integrated N-channel FET and the III–V heterojunction bipolar transistor, input voltage range of a voltage regulator is reduced from 3–3.5 V to 2–2.3 V. This allows the HBT circuit to function in the high speed/high frequency circuit while a voltage regulator is still possible to provide a wide bias voltage range.

While the invention has been described with reference to embodiments employing N-channel field effect transistors and III–V heterojunction bipolar transistors, other technologies, such as silicon bipolar junction transistors and MOSFETs and other III–V material systems can be employed. Accordingly, while the invention has been described with reference to specific embodiments, the description is illustrative of the invention and is not to be construed as limiting the invention. Various modifications and applications may occur to those skilled in the art without departing from the true spirit and scope of the invention as defined by the appended claims.

What is claimed is:

1. A voltage regulator integrated circuit for high speed and high frequency applications comprising:

an input terminal for receiving an unregulated voltage;

an output terminal for receiving a regulated voltage;

a circuit ground terminal;

a first field effect transistor interconnecting said input terminal and said output terminal;

a bias circuit for biasing said first field effect transistor to maintain conductance thereof and regulate a voltage on said output terminal, said bias circuit including first and second resistors serially connected between said output terminal and said circuit ground terminal and having a common terminal;

a heterolunction bipolar transistor serially connected between said first field effect transistor and said circuit ground terminal and having a base region coupled to said common terminal and thereby establishing a bias voltage for said first field effect transistor; said field effect transistor and said heterojunction bipolar transistor comprising an integrated device in a unitary structure wherein said unitary structure comprises a III–V semiconductor substrate, an N+ doped subcollector region formed in said substrate, an N doped collector region formed in said N+ doped subcollector region and abutting a surface of said substrate, a P+ doped layer of III–V semiconductor material formed on said surface overlying said N doped collector region, an N doped layer overlying said P+ doped layer, and first and second spaced layers of N+ doped material overlying said N doped layer, said N doped layer functioning as an emitter of said heterojunction bipolar transistor and a channel region of said field effect transistor, and a third resistor connecting said input terminal to a common terminal of said first field effect transistor and said bipolar transistor.

2. The voltage regulator integrated circuit as defined by claim 1, and further including a second field effect transistor serially connecting said first field effect transistor to said output terminal, said second field effect transistor being controllable for disconnecting said output terminal in a power down mode.

3. The voltage regulator integrated circuit as defined by claim 1, and further including a second field effect transistor serially connected with said third resistor, said second field effect transistor being controllable for disconnecting said third resistor from said common terminal of said first field effect transistor and said bipolar transistor.

* * * * *